United States Patent [19]

Whitten

[11] Patent Number: 4,966,234

[45] Date of Patent: Oct. 30, 1990

[54] METHOD FOR DETERMINING THE FREE POINT OF A STUCK DRILLSTRING

[75] Inventor: Ronald G. Whitten, Berlin, Conn.

[73] Assignee: Teleco Oilfield Services Inc., Meriden, Conn.

[21] Appl. No.: 436,496

[22] Filed: Nov. 13, 1989

[51] Int. Cl.[5] ..... E21B 47/00; E21B 31/00

[52] U.S. Cl. ..... 166/250; 73/151; 175/40

[58] Field of Search ..... 166/250, 255, 301; 175/40; 73/151

[56] References Cited

U.S. PATENT DOCUMENTS

| | | | |
|---|---|---|---|
| 3,352,360 | 11/1967 | Kirby II | 166/250 X |
| 3,585,857 | 6/1971 | Moore | 73/151 |
| 3,762,218 | 10/1973 | Davis | 73/151 |
| 4,207,765 | 6/1980 | Kiff | 73/151 |
| 4,515,010 | 5/1985 | Weido et al. | 166/255 X |
| 4,694,902 | 9/1987 | Hormansdorfer | 166/250 X |
| 4,708,204 | 11/1987 | Stroud | 166/255 |

*Primary Examiner*—Stephen J. Novosad

*Attorney, Agent, or Firm*—Fishman, Dionne & Cantor

[57] ABSTRACT

A method for determining the free point of a stuck drillstring is disclosed. The method includes determining the hookload on the stuck drillstring, comparing the hookload on the stuck drillstring with the most recent hookload prior to drillstring sticking to determine the depth of the free point.

6 Claims, 4 Drawing Sheets

METHOD FOR DETERMINING THE FREE POINT OF A STUCK DRILLSTRING

TECHNICAL FIELD

This invention relates to the field of sensing of borehole parameters, particularly parameters of interest in the drilling of oilwell boreholes.

BACKGROUND OF THE INVENTION

In the directional drilling of oil well boreholes, it is not uncommon for the drillstring to become mechanically stuck within the borehole. The recovery and replacement cost associated with a stuck drillstring are very high. Accordingly, there is an interest in the art in developing methods for minimizing such recovery and replacement costs. Determining the free point of a stuck drillstring allows removal of the maximum possible quantity of drillstring from the wellbore on the first pass and thus reduction in the number of passes necessary for the attempted removal of the remaining drillstring.

There are two conventional methods for determining the Point in the drillstring below which the string is stuck and above which the string is free.

The Brouse method involves applying excess tension to the drillstring, i.e. overpull, and measuring the resultant stretch of the drillpipe. Using the measurements of applied force and stretch in view of a simple mechanical relationship determines the length of pipe above the free point. The method assumes that there exists a length of drillpipe of uniform physical dimensions and properties between the surface and the free point. Several problems are associated with the Brouse method. It is necessary to apply additional tensile loading to the drillstring to induce stretching of the pipe.

There exists a risk that depending upon the condition of the pipe, the drillstring could be torn apart by the application of the excess force. The problem becomes more serious in situations where various sizes of pipe, made from different materials, are used in a tapering configuration, e.g. as in horizontal drilling. The method is reasonably accurate when the drillstring between the stuck point and the surface consists of a number of sections of drillpipe each having similar physical properties and dimensions. The Brouse method becomes increasingly inaccurate with increasing drillstring complexity. Finally, the Brouse method is unable to estimate the free point if it occurs within the bottom hole assembly.

A wire line tool may also be used to determine the free Point. The wire line tool method requires that a tool be run inside the drillstring on an electric line. The tool is positioned near the estimated free point. The tool has means to fix its position relative to the drillstring. With the tool in place, tensile and rotational forces are applied to the drillstring. The relative movement of the tool ends is measured, and the location of the free point is determined from these measurements. Several problems are associated with the wire line tool method of free point determination. The drillstring is subjected to excess tensile and torsional forces which increase the risk of failure of the drillpipe as discussed above. The wireline tool method is very time consuming and expensive requiring the use of an electric wireline and qualified operators. The method is inherently unsafe due to the presence of the wireline in the drillpipe and requires elaborate precautions against a well blow out. The method is generally accurate in most situations.

What is needed in the art, is a method for determining the free point of a stuck drillstring which overcomes the above deficiencies.

SUMMARY OF THE INVENTION

A method for determining the free point of a drillstring that has become stuck in a borehole is disclosed. The borehole extends substantially downwardly through a formation from a to end to a bottom end. The drillstring includes a plurality of elements extending along the borehole from the top end of the borehole through the free point to the bottom end of the borehole. The elements below the free point are stuck and the elements above the free point are free to move. The method includes slacking off on the drillstring and determining an observed hookload for the drillstring during slackoff. The position of the free point is estimated. A calculated hookload is then calculated, assuming a truncated drillstring, wherein the truncated drillstring comprises the drillstring elements between the top end of the borehole and the estimated free point position. The calculated and observed hookloads are compared. The free point estimation, hookload calculation and comparison steps are repeated until the calculated hookload agrees with the measured hookload within a predetermined tolerance. The free point is found to correspond to a particular estimated free point if a calculated hookload based on a truncated drillstring extending between the top end of the borehole and the particular estimated free point agrees with the observed hookload within the predetermined tolerance.

DESCRIPTION OF THE PREFERRED EMBODIMENTS

A drillstring is used to drill an oil well borehole through a geological formation. The drillstring extends from a drilling platform on the surface of the formation to a bit at the bottom of the borehole and comprises a plurality of elements including drillpipe elements and a bottom hole assembly (BHA). Drillpipe elements extend from the drilling platform to the top of the BHA. The BHA extends from the bottom drillpipe element to the bit. The BHA includes the bit, reamers and stabilizers of the drillstring.

If it is believed that the drillstring has become stuck in the borehole, the drillstring is slowly slacked off and the hookload is observed during slackoff. The hookload stabilizes when the rock formation supports the weight of the drillstring below the free point. The stable hookload observed during slackoff is recorded and is defined as the observed slackoff hookload.

A value is calculated for the theoretical slackoff hookload for the drillstring from the bit to the top end of the drillstring by sequentially calculating the tensile forces on each element of the drillstring from the bit to the top end of the drillstring.

Figure 1:
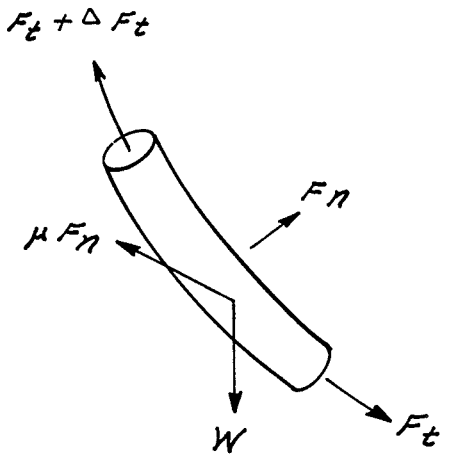
FIG. 1 shows a force balance on a drillstring element.

FIG. 1 shows a force balance on a bottom hole assembly element 2 illustrating the sources of normal force The forces on each element of the drillstring may be calculated using the equations for slacking off the drillstring:

$$Fn=((Ft_b\Delta\alpha\sin\bar{\theta})^2+(Ft_b\Delta\theta+W\sin\bar{\theta}^2)^{\frac{1}{2}} \quad (1)$$

$$\Delta Ft=W\cos\bar{\theta}-\mu Fn, \quad (2)$$

$$Ft_t=Ft_b+\Delta Ft \quad (3)$$

where:

$Fn$=normal force on element (lbf),
$Ft_b$=tensile force on element bottom (lbf),
$Ft_t$=tensile force on element top (lbf),
$\Delta\alpha$=azimuth change over element (radians),
$\bar{\theta}$=mean inclination of element (radians),
$\Delta\theta$=inclination change over element (radians),
$W$=air weight of element (lb),
$\Delta Ft$=incremental tension (lbf), and
$\mu$=friction factor.

When proceeding sequentially upwardly from the bottom of the drillstring, the tensile force on the bottom of the element is equal to the tensile force on the top of the previous element in sequence, assuming that the geometry of the elements is the same.

The hydrostatic effect on the drillstring will change each time the geometry of the element cross-sectional area changes. The proper treatment of these changes requires that the true vertical depth at these changes is known. The hydrostatic pressure is calculated for that depth and the forces acting on the two cross sectional areas is calculated. To calculate the effective force Ft acting on the bottom of the upper element, the following manipulation is performed:

$$Ft_{bH}=Ft_{t1}-H\pi/4(OD_1^2-OD_2^2-ID_1^2+ID_2^2), \quad (4)$$

where:

$Ft_{bH}$=tensile force on bottom of element, corrected for hydrostatic forces,
$Ft_{t1}$=tensile force on top of previous element,
$H$=hydrostatic pressure acting on the element,
$OD_1$=outer diameter of previous element,
$OD_2$=outer diameter of element,
$ID_1$=inner diameter of previous element, and
$ID_2$=inner diameter of element.

$Ft_{bH}$ may then be substituted for $Ft_b$ in equation 3 above in order to calculate the forces on the element.

The observed slackoff hookload is compared to the calculated slackoff hookload. If the drillstring is stuck, the observed hookload value will be lower than the calculated hookload value.

If the drillstring is found to be stuck, a free point position is estimated. A calculated slackoff hookload is calculated for a truncated drillstring wherein the truncated drillstring comprises the drillstring elements between the platform and the estimated free point position. The calculated slackoff hookload for the truncated drillstring is compared to the observed slackoff hookload.

If the calculated slackoff hookload agrees with the observed slackoff hookload within a predetermined tolerance, e.g. within about 1%, the estimated free point is determined to correspond to the actual free point. If the calculated slackoff hookload does not agree with the observed slackoff hookload, the calculated slackoff hookload is recalculated based on a second truncated drillstring extending between the platform and the second estimated free point. The sequence is repeated until the calculated slackoff hookload agrees with the observed slackoff hookload within a predetermined tolerance.

FIGS. 2A, 2B, 2C and 2D are a flow chart outlining the process steps of the method of the present invention. Starting from the top of FIG. 2A, the observed slackoff hookload from file 2, drillstring data from file 8, historical survey data from file 12, casing data from file 16, and mud data from file 20 are input (functional blocks 4, 10, 14, 18, and 22) to initialize the system. Drillstring data includes the length, inner diameter, outer diameter and the specific weight of each drillstring element. Historical data includes previously measured values for depth, inclination and azimuth of the wellbore, as well as calculated values for the true vertical bit depth at each measurement depth.

Casing data includes measured depth at the bottom of each casing string and the inner diameter of the innermost string.

Mud data includes mud weight. The hydrostatic force acting on the bit is calculated (functional block 24).

The initial tension value is set equal to the upward pressure exerted by the hydrostatic column of fluid in the wellbore acting on the cross sectional area of the drillstring at the vertical depth of the bit increased by the weight on the bit.

Figure 2C:
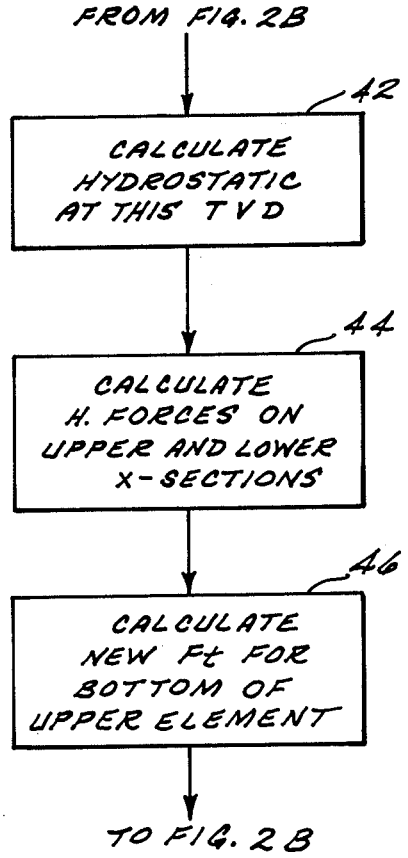
FIGS. 2A, 2B, 2C and 2C and 2D show shows a flow chart outlining the method of the present invention.
Figure 2A:
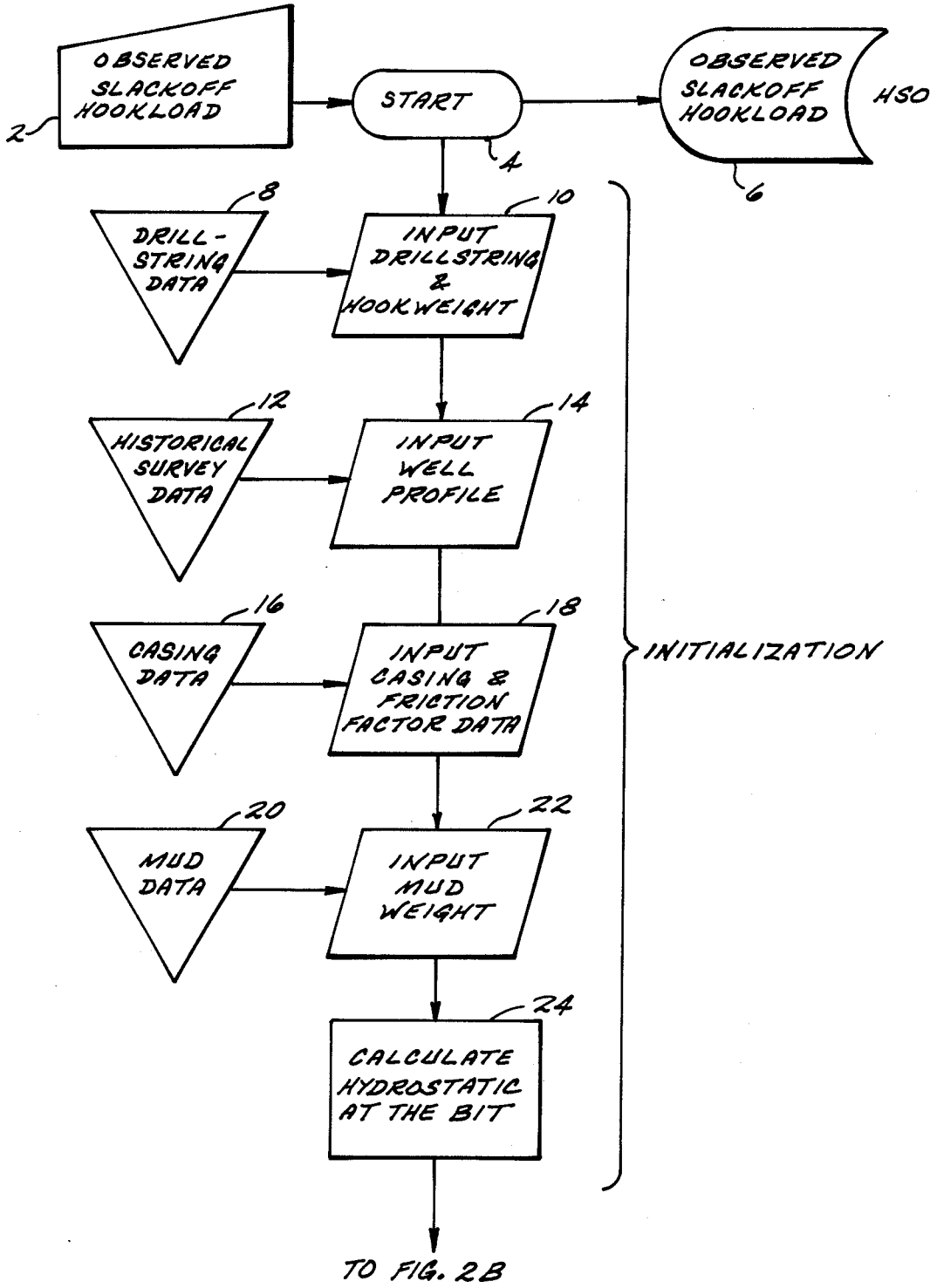
Figure 2B:
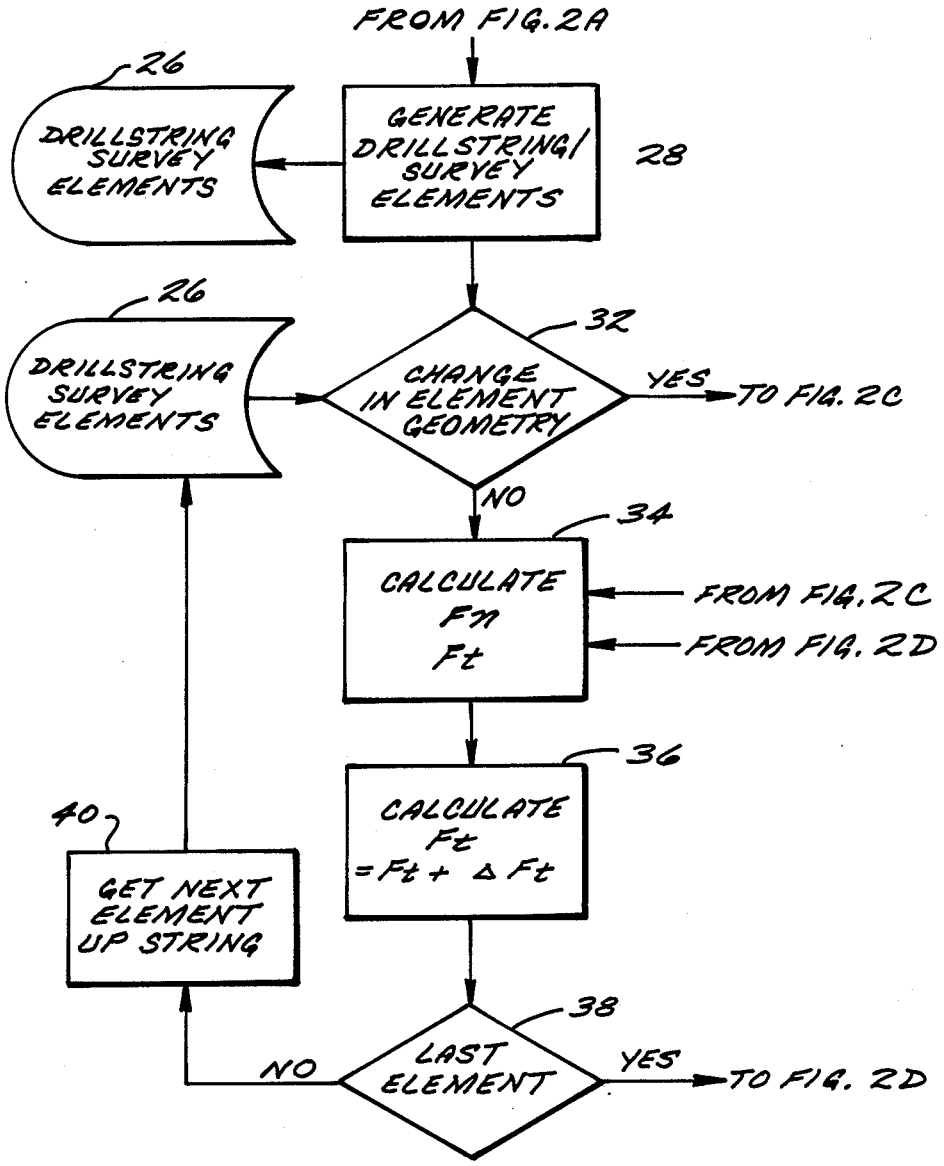

Continuing from the top of FIG. 2B, the drillstring is divided into a plurality of computational elements (functional block 28). Data defining the elements is filed in the element file 26. The initial conditions and the data defining the elements are used to calculate the forces on the elements. The system flow passes from functional block 28 to the "change in geometry" test (functional block 32).

If the geometry of the element is different from the geometry of the previous element, the system flow passes to FIG. 2C.

Starting from the top of FIG. 2C, the hydrostatic pressure at the depth of the bottom of the element is calculated (functional block 42). The hydrostatic forces at the cross sections of the element and the previous element are calculated above (functional block 44) and the tensile force on the bottom of the element is recalculated (functional block 46) according to equation 2 given below. The system flow then returns to FIG. 2B at functional block 34.

Figure 2D:
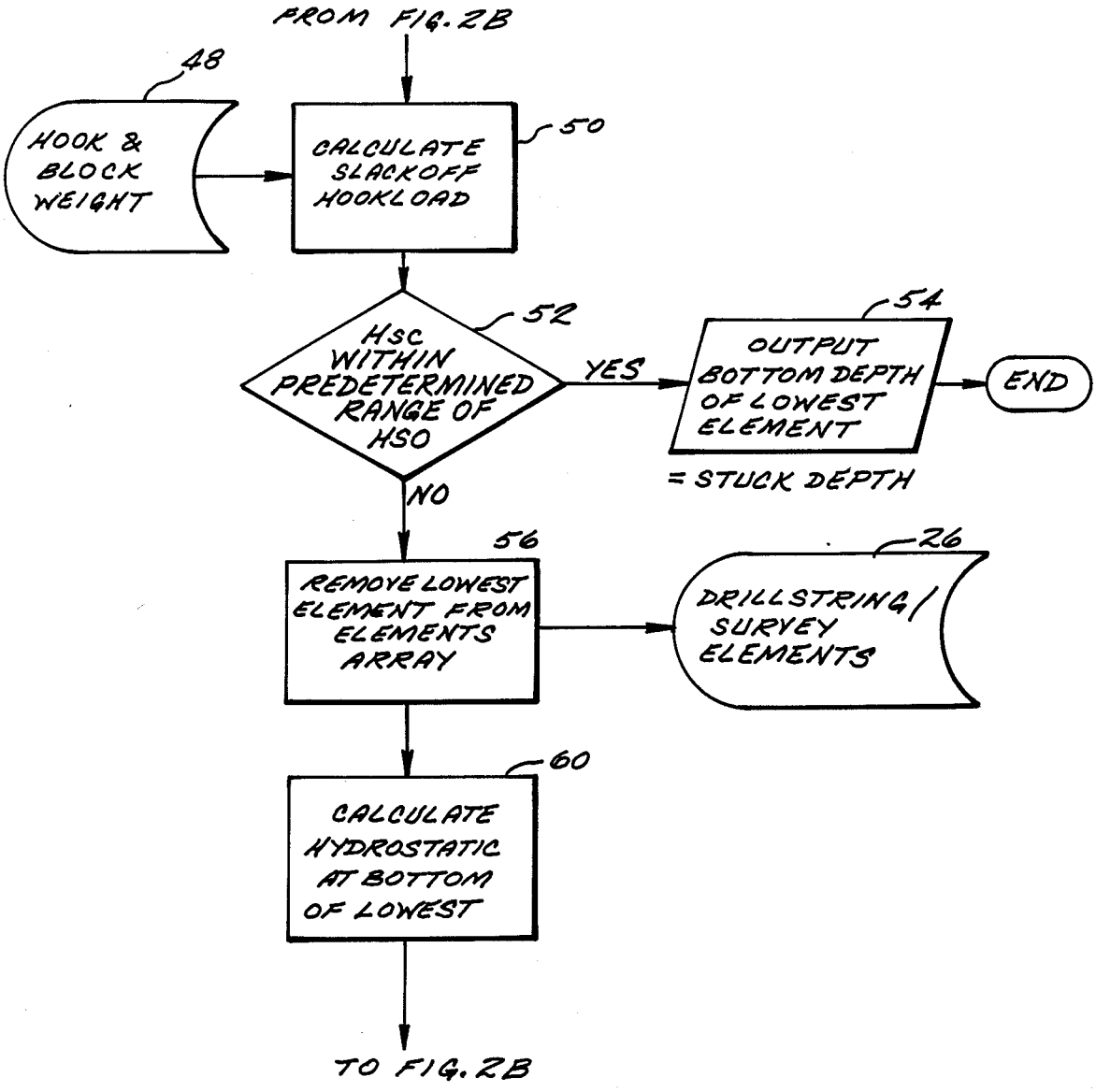

If the element is the first element, if the geometry of the element is the same as the previous element, or if the tensile force on the bottom of the element has been recalculated according to the steps outlined in FIG. 2D, the system flow passes to the calculation of the normal force on the element and the change in tensile force over the element (functional block 34) and onto the calculation of the tensile force on the top of the element (functional block 36) according to equations 1, 2 and 3 above.

As the calculation of the forces on the element is completed, a "last element" test is conducted (functional block 38).

If the element is not the last element of the drillstring, the data defining the next element is retrieved (functional blocks 40) from file 26 and the loop is reentered at functional block 32 for calculation of the forces on the next element.

If the element is the last element of the drillstring, the system flow passes from the "last element" test of functional block 32 to FIG. 2D.

Starting from the top of FIG. 2D, the hook and block weight data from file 48 are entered and the slackoff hookload is calculated (functional block 50). The slackoff hookload is compared with the observed hookload (functional block 52). If the calculated hookload does not agree with the observed hookload within a predetermined tolerance, the lowest element of the drillstring is removed from the program and stored in the drillstring/survey element file 26. The hydrostatic pressure is calculated at the bottom of the new lowest element (functional block 60) and the system flow returns to FIG. 2B at functional block 34.

The normal force on the element and the change in tensile force over the element (functional block 36) and the tensile force on the bottom of the next element (functional block 38) are calculated for each element in the drillstring. When the last element is reached, the system flow passes to the FIG. 2D and the slackoff hookload for the shortened drillstring is calculated (functional block 50). The calculated slackoff hookload is again compared with the observed hookload (functional block 52). The above described steps are repeated until the calculated slackoff hookload agrees with the observed slackoff hookload within a predetermined tolerance.

When the calculated slackoff hookload agrees with the observed slackoff hookload within the predetermined tolerance, the test is satisfied and it is determined that the bottom depth of the lowest element of the drillstring corresponds to the depth of the free point.

The method of the present invention allows determination of the free point of a stuck drillstring. Unlike conventional methods for determining the free point, the method of the present invention does not involve the application of excess tensile or torsional forces to the drillstring, so that the method of the present invention does not increase the risk of drillstring failure. Unlike the conventional wireline method for determining the free point, the method of the present invention does not increase the risk of well blow out.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for determining the free point of a drillstring that has become stuck in a borehole, said borehole extending substantially downwardly through a formation from a top end to a bottom end, said drillstring comprising a plurality of elements extending along the borehole from a top end of the drillstring at the top end of the borehole through the free point to a bit at the bottom end of the borehole, wherein the elements of the drillstring below the free point are stuck and the elements of the drillstring above the free point are free, comprising:

(a) slacking off on the drillstring;

(b) determining an observed hookload value for the drillstring during slackoff;

(c) estimating an estimated free point position;

(d) calculating a calculated hookload assuming a truncated drillstring, wherein the truncated drillstring comprises the drillstring elements between the top end of the drillstring and the estimated free point position;

(e) comparing the calculated hookload to the observed hookload;

(f) repeating steps c, d and e until the calculated hookload agrees with the measured hookload within a predetermined tolerance;

wherein the free point is found to correspond to a particular estimated free point if the calculated hookload based on a truncated drillstring extending between the top end of the drillstring and the particular estimated free point agrees with the observed hookload within the predetermined tolerance.

2. The method of claim 1, wherein tensile forces are exerted on each element of the truncated drillstring and the calculated hookload is calculated by the steps of:

calculating the tensile force on the top of the drillstring element at the top end of drillstring by sequentially calculating the tensile forces on the top of each element of the truncated drillstring from the estimated free point position to the top end of the drillstring.

3. The method of claim 2, wherein each element has a cross sectional area, and calculation of the tensile force on the top of each element includes calculating the hydrostatic force on each element having a cross sectional area that is different than the cross sectional area of the preceding element.

4. The method of claim 2, wherein the tensile force on the top of each element of the drillstring is calculated according to:

$$Ft_t = Ft_b + \Delta Ft$$

where:

$\Delta Ft = W\cos\bar{\theta} - \mu Fn$, $Fn = ((Ft_b \Delta\alpha \sin\bar{\theta})^2 + (Ft_b \Delta\theta + W \sin\bar{\theta}^2)^{\frac{1}{2}}$ $Fn$ = normal force on element (lbf), $Ft_b$ = tensile force on element bottom (lbf), $Ft_t$ = tensile force on element top (lbf), $\Delta\alpha$ = azimuth change over element (radians), $\bar{\theta}$ = mean inclination of element (radians), $\Delta\theta$ = inclination change over element (radians), $W$ = air weight of element (lb), $\Delta Ft$ = incremental tension (lbf), and $\mu$ = friction factor.

5. The method of claim 4, wherein a particular element is above a previous element, and wherein:

$$Ft_b = Ft_{t1}$$

where $Ft_{t1}$ = tensile force on the top of previous element.

6. The method of claim 3, wherein a particular element is above a previous element, the particular element and an inner diameter $ID_2$ and an outer diameter, $OD_2$, the previous element has a inner diameter $ID_1$ and an outer diameter $OD_1$ and $(OD_1^2 - ID_1^2) \neq (OD_2^2 - ID_2^2)$, further comprising:

calculating a tensile force on the bottom of the particular element that includes hydrostatic forces on the element, according to $$Ft_{bh} = Ft_{t1} - H\,\pi/4\,(OD_1^2 - OD_2^2 - ID_1^2 + ID_2^2), \quad (4)$$

where:

$Ft_{bH}$ = tensile force on bottom of element, corrected for hydrostatic forces, $Ft_t$ = tensile force on top of previous element, $H$ = hydrostatic pressure acting on the element, $OD_1$ = outer diameter of previous element, $OD_2$ = outer diameter of element, $ID_1$ = inner diameter of previous element, and $ID_2$ = inner diameter of element.

* * * * *